United States Patent [19]

Elliott et al.

[11] Patent Number: 4,744,160

[45] Date of Patent: May 17, 1988

[54] FABRIC PRESSING MACHINE USING SUPERHEATED STEAM

[75] Inventors: George M. Elliott, Alpharetta; Michael P. Adams, Woodstock, both of Ga.

[73] Assignee: Astechnologies, Inc., Roswell, Ga.

[21] Appl. No.: 905,406

[22] Filed: Sep. 10, 1986

[51] Int. Cl.[4] ..... D06F 71/34

[52] U.S. Cl. ..... 38/15; 38/16; 100/93 P; 156/497; 219/275

[58] Field of Search ..... 34/48; 162/290, 359; 219/275; 122/4 A; 99/454; 38/15, 16; 100/93 P, 73; 156/500, 497; 68/5 A, 6–8; 8/149.3

[56] References Cited

U.S. PATENT DOCUMENTS

| | | | |
|---|---|---|---|
| 2,777,750 | 1/1957 | Sprague et al. | 8/131 |
| 3,388,965 | 6/1968 | Garrett | 8/149.3 X |
| 3,603,119 | 9/1971 | Kawaguchi | 68/5 R |
| 3,896,572 | 7/1975 | Jeffness | 38/77.83 |
| 3,901,053 | 8/1975 | Meisen et al. | 219/275 X |
| 4,112,131 | 9/1978 | Bosy et al. | 99/454 X |
| 4,302,895 | 12/1981 | Pertl | 38/15 |
| 4,408,116 | 10/1983 | Turner | 219/275 X |

*Primary Examiner*—Andrew M. Falik

*Attorney, Agent, or Firm*—Sutherland, Asbill & Brennan

[57] ABSTRACT

A steam pressing machine comprising a perforated steam platen and means for pre-heating the platen, e.g., an electric heater, is improved by providing it with a source of superheated steam for ejection out of the platen, rather than saturated steam. This allows the use of lower platen temperatures, and, therefore, lower fabric temperatures. Pressing is faster, because the fabric takes less time to cool, and nap-crushing and shining are less of a problem.

17 Claims, 1 Drawing Sheet

FABRIC PRESSING MACHINE USING SUPERHEATED STEAM

This invention relates to an improved steam pressing machine.

Steam pressing machines used to press fabric, either as piece goods or garments, comprise a perforated steam plate, or platen, adapted to be closed against the fabric, and means for ejecting steam through the holes in the plate into the fabric. Normally these machines operate with dry saturated steam at a pressure of approximately 80 pounds per square inch gauge (psig). The temperature of 80 psig saturated steam is approximately 324° F. In some pressing machines, electric heaters are used to pre-heat the platen, e.g., to a temperature of at least about 280° F., e.g., approximately 300° F. This helps prevent condensation, which can spot a fabric, sometimes permanently. With many fabrics, however, a platen temperature of 300° F. can be damaging. The pressure of such a hot platen can distort nap in the fabric and give the fabric a shiny appearance.

The present invention improves such a steam pressing machine by providing it with means for ejecting superheated steam, rather than saturated steam, from the steam plate. The superheated steam preferably is at a temperature at least about 100 Fahrenheit degrees above the saturation temperature corresponding to the pressure of the steam. The steam pressure preferably is kept within the prior art range of about 40 to 90 psig, however, most preferably between about 75 and 90 psig.

By virtue of the use of the superheated steam, our platen temperature can be maintained at a much lower temperature than in the standard pressing machines. Instead of maintaining the platen at a temperature of 280° F. or above, we can maintain the temperature of the platen as low as about 200° F. and still avoid condensation. At the same time, we can adjust the moisture content of the steam according to the particular fabric to be pressed. Our steam temperature may be raised to produce drier steam, or lowered to conduct more moisture to the fabric, without altering the steam pressure. This permits one to avoid many of the shine and nap distortion problems caused by the use of high platen temperatures. Also, it allows for shorter cycle times.

The normal operation sequence for a steam pressing machine begins by closing the platen against the fabric with light pressure, then releasing the steam. After about three to ten seconds, the press is fully closed, exerting higher pressure against the fabric, and the steaming is continued for another three to ten seconds. Then the press is opened and vacuum is activated to cool and dry the fabric. Normally, the vacuum will be pulled through the opposite tool from the steam plate. The steam plate normally will be the top tool. It is called the head, and the opposite tool is called the bottom buck. The fabric preferably is cooled to below 175° F. before being lifted off the bottom buck. This is necessary in order to prevent the fabric from being damaged or wrinkled. Using the improved machine of this invention, the fabric can be pressed quite well using a platen temperature of, say, only about 210° F. This means the fabric then can be cooled to below 175° F. in a much shorter time than with prior art machines operating at platen temperatures of 280° F. or more. Also, because of the higher temperature of the steam being ejected into the fabric, the pressing time can be reduced. For example, we have successfully pressed flat garments using the machine of the present invention in only 12 seconds, whereas use of a conventional steam pressing machine would require up to 30 seconds.

Preferably the machine is equipped with pressure vessel means having internal electric heater means capable of heating 80 psig saturated steam to a temperature of at least about 600° F. Most preferably such means comprises two pressure vessels, each with an electric heater, connected in series. This arrangement facilitates the removal of sediment from the saturated steam entering the first vessel. The first vessel preferably is capable of heating saturated steam, e.g., having a pressure of about 40 to 90 psig, to a temperature at least about 50 Fahrenheit degrees above the saturation temperature corresponding to the pressure of the steam. The second vessel preferably is capable of heating the superheated steam coming over from the first vessel to a temperature at least about 300 Fahrenheit degrees above the saturation temperature, and most preferably at least about 400 degrees above saturation. The vessels should be capable of holding the pressure of the saturated steam relatively constant. A conventional steam trap may be installed in the drain line from the bottom of each vessel to remove condensation and help maintain a steady pressure.

Temperature sensors are preferably included in each superheater vessel. If an electric heating element is located in the center of the vessel (which is preferred), one sensor can be mounted between the element and the vessel wall, to measure and control the temperature of the steam, and a second sensor can be in direct contact with the heating element. The second sensor can be connected to current control means that will prevent overheating and damage to the element.

The normal hole size in pressing machine steam plates of the prior art is about 0.090 to 0.125 inch. Using superheated steam, it is preferred to keep the hole size within the range of about 0.030 to 0.085 inch. Also, if the steam plate has a rather large surface, it is preferred to compartmentalize the interior and provide a separate inlet for the superheated steam to each compartment. Each inlet should have its own control valve so as to be able to balance the steam ejection across the plate. Thus, the steam plate perferably contains at least two steam compartments, each of which is connected to an independently controllable supply line of the superheated steam.

The machine must have means apart from the superheated steam to heat the platen surface. An electric heater is preferred. The heater preferably is capable of pre-heating the platen to a temperature of at least about 200° F. Most preferably it will be capable of holding the platen temperature at any pre-set temperature (plus or minus 5°) within the range of about 200° to 400° F. A temperature of about 400° F. is about the maximum to which one would ever want to heat the steam plate.

The invention will be better understood by referring to the drawings accompanying this specification.

Figure 1:
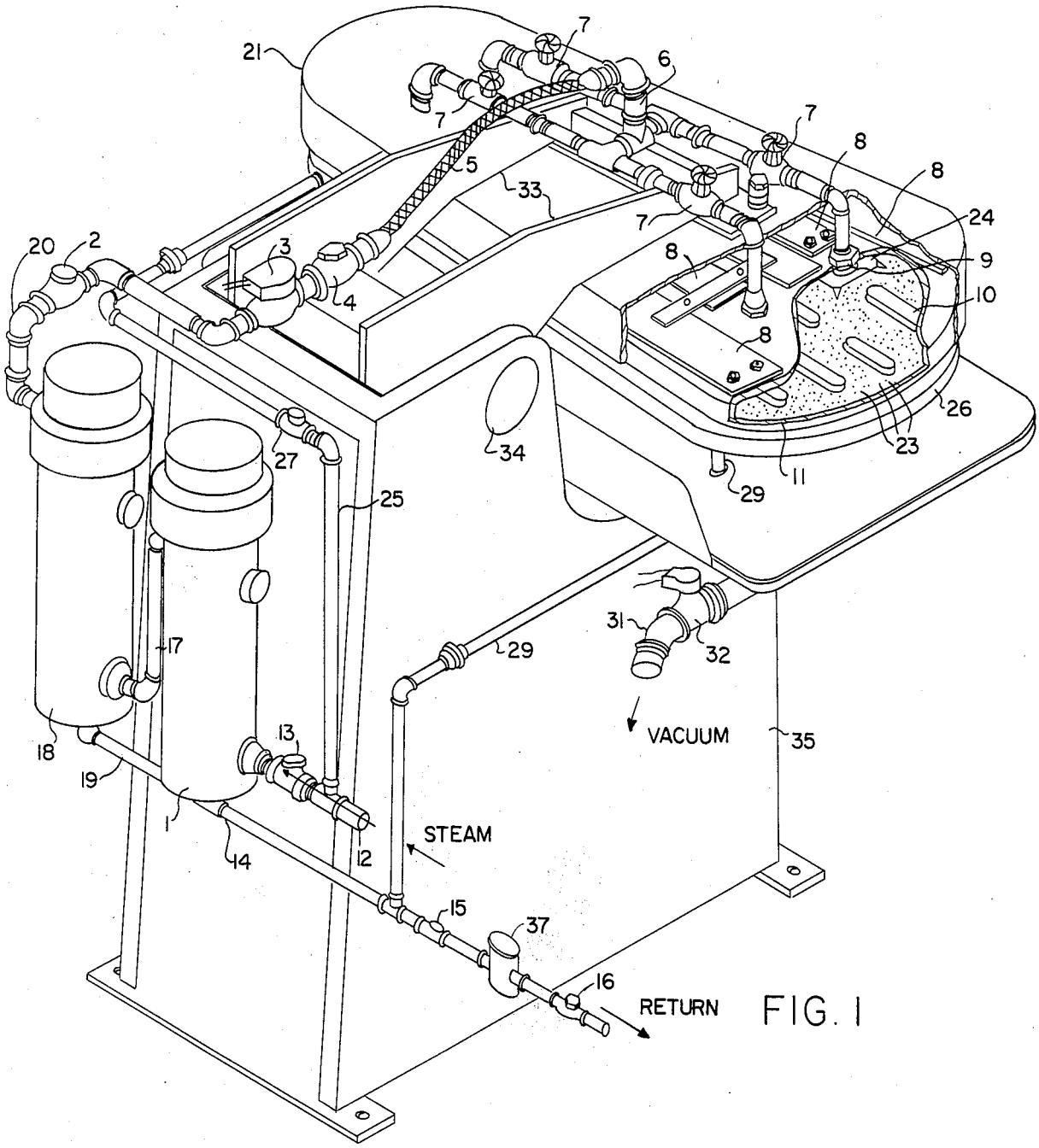
FIG. 1 is an isometric view (partially broken away) of a conventional clam shell pressing machine, known as a legger, which has been modified according to the present invention. The machine is shown with the head closed against the bottom buck.
Figure 2:
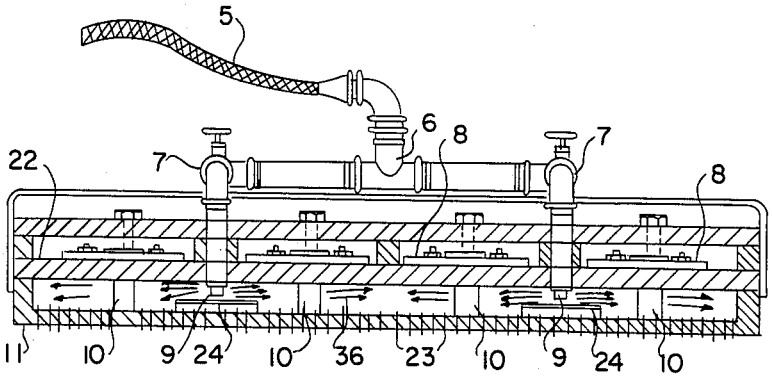
FIG. 2 is a cross-sectional view of the top tool, or head, of the machine depicted in FIG. 1.

Referring to the drawings, saturated 80 psig steam enters pressure vessel 1 via line 12 and manual on-off valve 13. The steam is heated in vessel 1 to 375° F., while maintaining the 80 psig pressure. Condensate is removed from vessel 1 via line 14, which is equipped with a particle strainer 15, a 125 psig steam trap 37, and a check valve 16. The 375° F. steam from vessel 1 flows via open line 17 over into pressure vessel 18. Condensate from vessel 18 is removed via drain line 19, which connects with line 14. The steam in vessel 18 is heated to about 475° F. Each of vessels 1 and 10 is equipped with an electric heating element (not shown).

Superheated steam at 475° F. and 80 psig flows out of vessel 18 via line 20, which is controlled by solenoid valve 3. Check valves 2 and 4 prevent back flow in line 20. A flexible, stainless steel line 5 conveys the steam to manifold 6, which releases the steam to four flow control valves 7. Each valve 7 controls the flow of the superheated steam through an orifice 9 in the top of steam plate 21. The interior chamber 36 of plate 21 is evenly divided across the short dimension into two steam compartments by a vertical partition (not shown). The contact surface 11 of steam plate 21 is perforated with holes 23 having a diameter of about 0.045 inch and spaced about 0.500 inch apart. Attached to the top side of the ceiling 22 of chamber 36 are a plurality of electric heating elements 8. Inside each steam compartment are vertical heat transfer ribs 10, which serve to transmit the heat from elements 8 to the contact surface 11 of the top tool. Mounted in front of each steam orifice 9 is a baffle 24 to help disperse the steam throughout the compartment.

Bottom buck 26 of the machine has a standard internal configuration, including a steam heating pressure chamber (not shown) on the bottom and a blow chamber (also not shown) above. The ceiling of the blow chamber is perforated and the outer surface of the perforated ceiling is covered with a press padding set, which is what the fabric to be pressed is laid upon.

A side stream of the saturated steam from line 12 is taken off from line 25 and is routed through the steam heating pressure chamber (not shown) of bottom buck 26. This keeps the surface of the press padding at a temperature of about 210°–220° F. Check valve 27 prevents back flow in line 25. Condensate and water vapor from bottom tool 26 flow through line 29 into return line 14. Vacuum line 31, controlled by solenoid valve 32, is connected to the blow chamber (not shown) in bottom tool 26.

Steam plate 21 is carried by a pair of cantilevered arms 33, which are pivotally connected by shaft 34 to machine frame 35. Air cylinders (not shown) are used to lift and lower arms 33, thereby raising and lowering head 21. Bottom buck 26 is stationary.

We claim:

1. In a machine for pressing and smoothing fabric comprising a hollow perforated steam plate mounted for closing against the fabric to be pressed, steam supply means for delivering steam to the interior of said plate at a pressure high enough to cause the steam to be ejected from the holes in said plate, and means apart from the steam for preheating the plate, the improvement wherein the steam supply means includes a superheater means to deliver the steam at a pressure in the range of about 40 to 90 psig and at a temperature higher than that of the plate and at least about 100 Fahrenheit degrees above the saturation temperature corresponding to the pressure of the steam resulting in the avoidance of the formation of moisture condensation on the plate.

2. The steam pressing machine of claim 1 wherein said superheater means includes a superheater vessel having a steam inlet and a steam outlet and containing an electric heater capable of heating 80 psig steam in the vessel to a temperature of at least about 600° F. and steam conduit means connecting said steam outlet with the interior of said plate.

3. The pressing machine of claim 2 wherein the holes in the steam plate have a diameter in the range of about 0.030 to 0.085 inch.

4. The pressing machine of claim 2 wherein the steam plate contains at least two steam compartments, each of which is connected to an independently controllable supply line of the superheated steam.

5. The steam pressing machine of claim 1 wherein said superheater means includes a first superheater vessel and a second superheater vessel, each vessel having a steam inlet and a steam outlet and containing an electric heater; steam conduit means connecting the outlet of said first vessel to the inlet of said second vessel; and steam conduit means connecting the outlet of said second vessel to the interior of said plate; the electric heater of said first vessel being capable of heating 40 to 90 psig saturated steam in the vessel to a temperature at least about 50 Fahrenheit degrees above the saturation temperature corresponding to the pressure of the steam, and the electric heater of said second vessel being capable of heating superheated steam from the first vessel to a temperature at least about 300 Fahrenheit degrees above the saturation temperature corresponding to the pressure of the steam.

6. The pressing machine of claim 5 wherein the means for pre-heating the steam plate is operable to pre-heat the plate to at least about 200? F.

7. The pressing machine of claim 6 wherein the holes in the steam plate have a diameter in the range of about 0.030 to 0.085 inch.

8. The pressing machine of claim 6 wherein each pressure vessel has means associated with it for maintaining a steam pressure inside the tank within the range of about 40 to 90 pounds per square inch gauge.

9. The pressing machine of claim 7 wherein each pressure vessel has means associated with it for maintaining a steam pressure inside the tank within the range of about 40 to 90 pounds per square inch gauge.

10. The pressing machine of claim 9 wherein the means for pre-heating the steam plate is operable to hold the plate temperature at any pre-set temperature within the range of about 200° to 400° F.

11. The pressing machine of claim 1 wherein the holes in the steam plate have a diameter in the range of about 0.030 to 0.085 inch.

12. The pressing machine of claim 11 wherein the steam plate contains at least two steam compartments, each of which is connected to an independently controllable supply line of the superheated steam.

13. The pressing machine of claim 12 wherein each pressure vessel has means associated with it for maintaining a steam pressure inside the tank within the range of about 75 to 90 pounds per square inch gauge.

14. The pressing machine of claim 13 wherein the means for pre-heating the steam plate is operable to hold the plate temperature at any pre-set temperature within the range of about 200° to 400° F.

15. The pressing machine of claim 14 wherein the means for pre-heating the steam plate is an electric heater.

16. The pressing machine of claim 1 wherein the means for pre-heating the steam plate is operable to hold the plate temperature at any pre-set temperature (puls or minus 5 degrees) within the range of about 200° to 400° F.

17. The pressing machine of claim 16 wherein the means for pre-heating the steam plate is an electric heater.

* * * * *

UNITED STATES PATENT AND TRADEMARK OFFICE

CERTIFICATE OF CORRECTION

PATENT NO. : 4,744,160

DATED : May 17, 1988

INVENTOR(S) : George M. Elliott & Michael P. Adams

It is certified that error appears in the above-identified patent and that said Letters Patent are hereby corrected as shown below:

Claim 6, line 3, "200?F." is corrected to read -- 200°F. --;

Claim 10, line 3, after "pre-set temperature" is inserted the phrase -- (plus or minus 5 degrees) --; and Claim 14, line 3, after "pre-set temperature" is inserted the phrase -- (plus or minus 5 degrees) --.

Signed and Sealed this

Twenty-seventh Day of December, 1988

*Attest:*

DONALD J. QUIGG

*Attesting Officer*

*Commissioner of Patents and Trademarks*